United States Patent [19]

Yoshida et al.

[11] Patent Number: 4,527,597

[45] Date of Patent: Jul. 9, 1985

[54] DOBBY

[75] Inventors: Kaichiro Yoshida, Kyoto; Yutaka Ueda, Nara, both of Japan

[73] Assignee: Murata Kikai Kabushiki Kaisha, Japan

[21] Appl. No.: 392,083

[22] Filed: Jun. 25, 1982

[30] Foreign Application Priority Data

Jun. 30, 1981 [JP] Japan ..... 56-102664

[51] Int. Cl.[3] ..... D03C 1/00; D03C 15/00

[52] U.S. Cl. ..... 139/68; 139/319; 139/331

[58] Field of Search ..... 139/68, 71, 66 R, 331, 139/319; 66/75.2, 232, 238; 112/79 A

[56] References Cited

U.S. PATENT DOCUMENTS 3,991,592 11/1976 Kahan et al. ..... 66/75.2
4,182,380 1/1980 Palau ..... 139/68
4,269,045 5/1981 Hida et al. ..... 66/75.2

FOREIGN PATENT DOCUMENTS 2338831 1/1975 Fed. Rep. of Germany ..... 139/1 R
2809248 9/1979 Fed. Rep. of Germany ..... 139/68
253240 11/1948 Switzerland ..... 139/68
485887 3/1970 Switzerland ..... 139/68

*Primary Examiner*—James Kee Chi
*Attorney, Agent, or Firm*—Spensley Horn Jubas & Lubitz

[57] ABSTRACT

Dobby for a weaving loom in which control of the operative and non-operative positions of retaining hooks or hook arms which are engaged with and disengaged from hooks of heald frame-driving levers to actuate desired heald frame is electrically performed through solenoids corresponding to the respective levers, which are actuated by an electronic control system having a micro-computer.

5 Claims, 4 Drawing Figures

DOBBY

BACKGROUND OF THE INVENTION

The present invention relates to a dobby, especially a device for controlling a retaining hook.

Ordinarily, a dobby card or peg is used for controlling the position of a retaining hook for determining whether or not a movable hook on a double lift balanced lever swung by a bar is engaged with the retaining hook. More specifically, a card or peg for controlling a retaining hook of a dobby is prepared based on a weave texture and the card or peg is attached to the dobby to effect the control of the retaining hook.

It is disclosed in U.S. Pat. Nos. 3,285,291, 3,884,273 and 4,182,380 that selective displacement of hooks or levers can be accomplished by means of electromagnets. In these known patents, however, dobby cards or pattern pegs are used.

SUMMARY OF THE INVENTION

The present invention is to provide a novel dobby in which a retaining hook is controlled by electric signals without using the above-mentioned cards or pegs.

According to the present invention, control of the operative and non-operative positions of retaining hooks or hook arms which are engaged with and disengaged from hooks of heald frame-driving levers to actuate desired heald frame motion is electrically performed through solenoids corresponding to the respective levers, which are actuated by an electronic control system having a micro-computer. Accordingly, a mechanical weave texture instructing mechanism arranged in the conventional dobbies, such as a dobby card or pattern peg, need not be used. In the conventional dobbies, in the case where the repetition weft number in the length direction of a weave is large, a very long dobby card is necessary and a special member such as a card guide should be disposed. In the present invention, such dobby card or card guide need not be used at all.

Furthermore, if storing elements (ROM) having weave data stored therein are prepared and an appropriate storing element is selected and used, a desired dobby texture can easily be obtained. Moreover, there can be adopted a modification in which standard textures are stored in advance and desired weave data are promptly read out according to instructions of memory addresses without exchange of storing elements.

Still further, such operations as pick-finding and levelling operations can be performed very easily and assuredly, and mechanical parts necessary for performing these operations mechanically need not be disposed at all. Accordingly, the apparatus can be made compact and the operation efficiency can be increased.

DETAILED DESCRIPTION OF THE INVENTION

The present invention will now be described in detail with reference to embodiments illustrated in the accompanying drawings.

Figure 1:
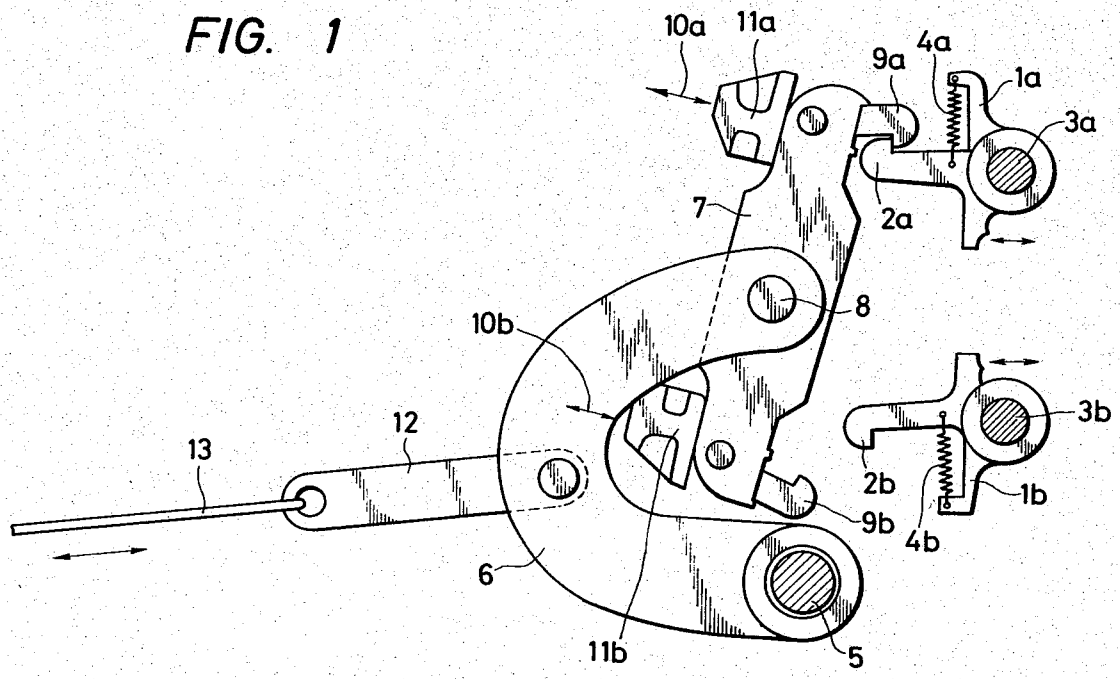
FIG. 1 is a view diagrammatically illustrating the main structure of an embodiment of the present invention which is applied to a double lift balanced lever dobby.

FIG. 1 is a view diagrammatically illustrating the structure of a double lift balanced lever type dobby. Retaining hooks 2*a* and 2*b* are pivoted at points 3*a* and 3*b* on levers 1*a* and 1*b* swung by a control device described hereinafter, and the retaining hooks 2*a* and 2*b* are urged to the levers 1*a* and 1*b* by springs 4*a* and 4*b*. The intermediate portion of a balanced lever 7 is pivoted at the position 8 on the top end of a lever 6 supported on a stationary shaft 5, and hooks 9*a* and 9*b* to be engaged with and disengaged from the retaining hooks are pivoted on both ends of the balanced lever 7. By engaging the hooks 9*a* and 9*b* with the retaining hooks 2*a* and 2*b*, respectively, by bars 11*a* and 11*b* reciprocatively moving in directions of arrows 10*a* and 10*b* cooperatively with a loom, the lever 6 is turned by a certain angle in the clockwise direction with the shaft 5 being as the center, and a jack lever 12 is pulled rightward and a wire cable 13 connected to the jack lever 12 is pulled, whereby a heald frame (not shown) connected to the top end of the wire cable is raised or lowered to effect the shedding operation of warp threads.

Figure 2:
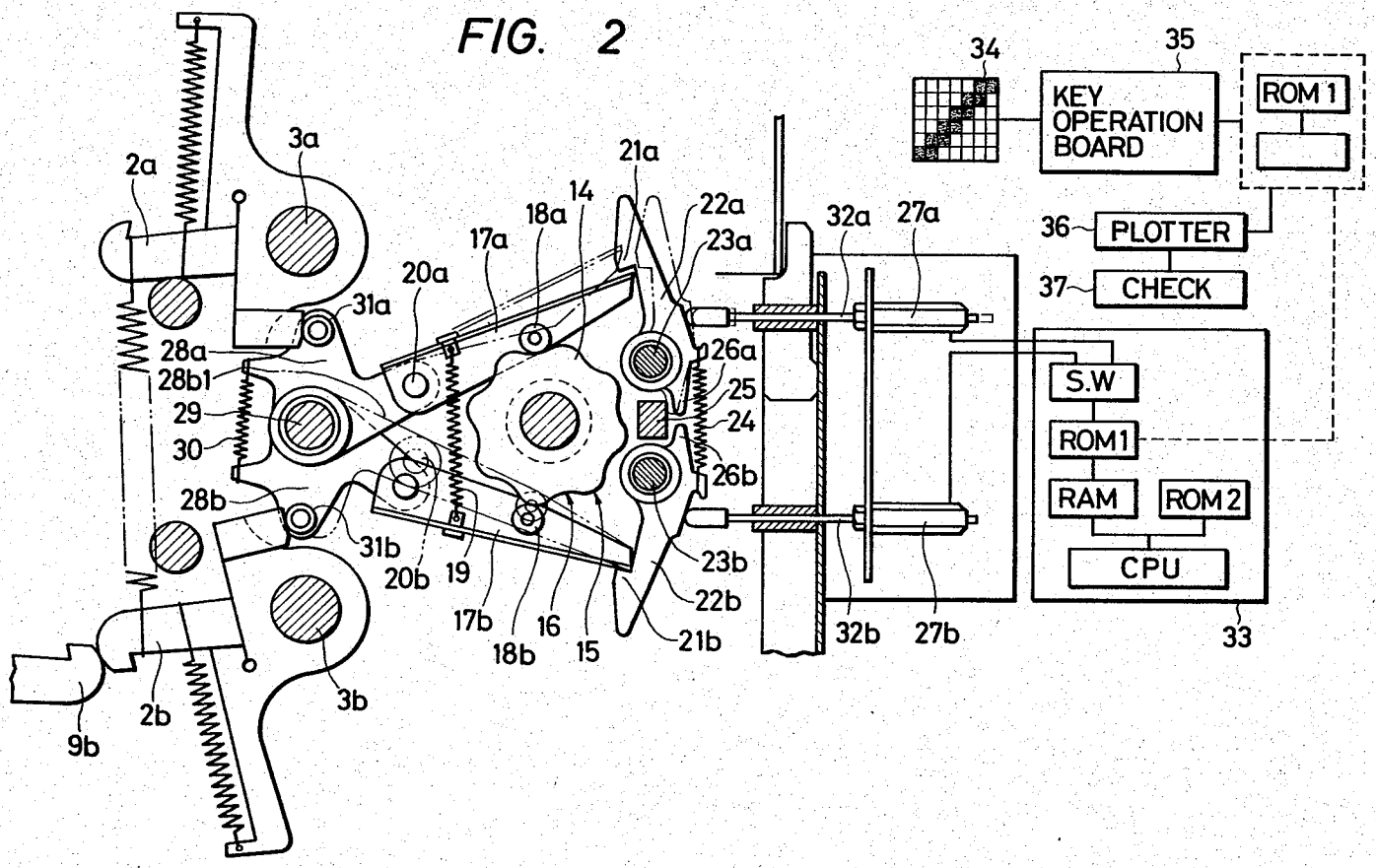
FIG. 2 is a view diagrammatically illustrating the structure of one embodiment of the apparatus of the present invention.

FIG. 2 illustrates an embodiment of the control device for controlling the retaining hooks 2*a* and 2*b* to the operative and non-operative positions.

A cam 14 which rotates synchronously with the rotation of a crank shaft of a dobby (not shown) is pivoted on a perpendicular bisector of the line connecting the centers of the pivoting shafts 3*a* and 3*b* of the retaining hooks 2*a* and 2*b*. Even numbers of peaks 15 and troughs 16 (eight peaks and eight troughs in the drawings) are formed on the cam face of the cam 14, and cam rollers 18*a* and 18*b* of paired locking levers 17*a* and 17*b* are pressed to the cam face by a spring 19 so that with rotation of the cam 14, the locking levers 17*a* and 17*b* are always oscillated with shafts 20*a* and 20*b* being as the centers. The cam rollers 18*a* and 18*b* are arranged on the locking levers 17*a* and 17*b* so that the vertical positions of the cam rollers 18*a* and 18*b* to the cam 14 are deviated by 180° from each other. A pair of catching levers 22*a* and 22*b* provided with hooks 21*a* and 21*b* are pivoted at points 23*a* and 23*b* in the vicinity of the top ends of the locking levers 17*a* and 17*b*, and these catching levers 22*a* and 22*b* are urged to the positions not engaged with the top ends of the locking levers 17*a* and 17*b* by means of a spring 24 and one ends 26*a* and 26*b* of the levers 22*a* and 22*b* are caused to abut against a stopper 25, whereby the levers 22*a* and 22*b* are locked at non-engaging positions. Small solenoids 27*a* and 27*b* or air cylinders are arranged in the side portions of the catching levers 22*a* and 22*b* so that the top ends of solenoid rods 32*a* and 32*b* abut against the catching levers 22*a* and 22*b*. When the solenoids are actuated, the catching levers 22*a* and 22*b* are slightly displaced with the shafts 23*a* and 23*b* being as the centers and become engaged with the top ends of the locking levers 17*a* and 17*b*.

A pair of push levers 28*a* and 28*b* having the locking levers 17*a* and 17*b* pivoted thereon at points 20*a* and 20*b* are pivoted on a stationary shaft 29 and they are connected through a spring 30 so that the lever 28*a* is urged in the counterclockwise direction and the lever 28*b* is urged in the clockwise direction. Cam rollers 31*a* and 31*b* formed on the push levers 28*a* and 28*b* are thus caused to abut against parts of the retaining hooks 2*a* and 2*b*, respectively.

For example, when the solenoid 27*b* is actuated to advance the solenoid rod 32*b*, the catching lever 22*b* is displaced from the position indicated by the two-dot chain line to the position indicated by the solid line, and the top end of the locking lever 17*b* always oscillated is restrained by the hook portion 21*b*, whereby the top end of the locking lever 17*b* is retained. If the cam roller 18 is raised in this state by rotation of the cam 14, the pivoting shaft 20*b* which has acted as the center of oscillation is turned in the counterclockwise direction with the top end of the locking lever 17*b* being as the center and the push lever 28*b* having the pivoting shaft 20*b* is turned from the position 28*b*1 indicated by the two-dot chain line to the position indicated by the solid line with the shaft 29 being as the center. The other end of the push lever 28*b* is displaced to turn the retaining hook 2*b* in the counterclockwise direction and locate the retaining hook 2*b* at the position for engagement with the hook 9*b*, whereby the hook 9*b* on the balanced lever is retained or retaining of the hook 9*b* is maintained.

When the other solenoid 27*a* is actuated, in the same manner as described above, the hook on the balanced lever is retained or retaining of the hook is maintained, and the heald frame is raised through the jack lever 12 shown in FIG. 1 according to the desired weave texture.

On-off control of the solenoids 27*a* and 27*b* is accomplished by an electronic control circuit 33. More specifically, in the weave texture reading zone, a data of a desired weave texture 34 is put and stored in a storing element, that is, a memory ROM1, through a key operation board 35, and the input signal is checked at a point 37 by a small plotter 36 and if there is no error, the memory ROM1 is taked out from the reading zone and attached to a dobby control circuit. In the electronic control circuit, a control program stored in a memory ROM2 and the weave texture signal stored in the memory ROM1 are processed by a central processor unit CPU, and on-off control of the solenoids 27*a* and 27*b* at the predetermined positions is performed through a switching circuit SW.

In the normal state, a desired weave texture is formed according to the stored data of the memory ROM1. In the case where the loom is stopped because of breakage of a weft thread and the loom is reversely rotated to reproduce a weft-broken shed, the data of the preceding one or two wefts is picked up co-operatively with the reverse rotation of the loom or according to another instruction and the catching levers 22*a* and 22*b* are actuated according to the picked-up data, whereby the desired shedding state is obtained.

In order to perform the so-called levelling operation of raising or lowering heald frame located at lower or upper positions for exchanging or knotting warp threads, a memory or switching circuit for actuating or de-energizing all the solenoids, which is arranged independently from the weave texture memory ROM1, is utilized.

Furthermore, there may be adopted a modification in which a plain weave texture is stored independently from the desired texture, the catch lever is actuated to form a shed according to the plain weave texture data. In this modification, when the loom is stopped in the vicinity of the crossing point, the mail heights of all the healds can be arranged at the substantially same level. That is, the function of the so-called tufting apparatus can be exerted.

Figure 3:
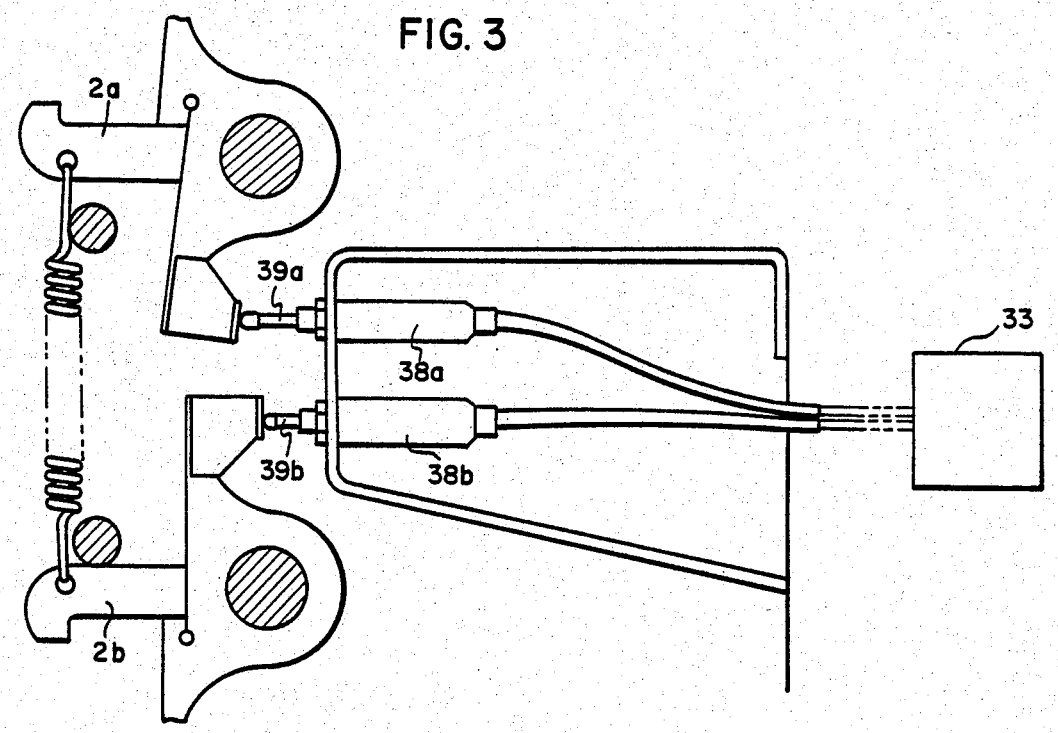
FIG. 3 is a view diagrammatically illustrating the structure of another embodiment of the apparatus of the present invention.

FIG. 3 illustrates another embodiment in which the retaining hooks 2*a* and 2*b* are directly controlled by solenoids 38*a* and 38*b* or air cylinders through rods 39*a* and 39*b* thereof. In this embodiment, the retaining hook is made to stand by at the retaining position by the solenoid and when the retaining hook is going to engage with the hook portion of the movable hook, a force acting in the reverse direction is imposed on the solenoid or air cylinder actuated to displace the retaining hook because of the contact pressure of the movable hook. Accordingly, a solenoid or air cylinder capable of overcoming the above force is used. However, the structure of such solenoid or air cylinder is very simple and occurence of erroneous control or other trouble can be prevented effectively. Incidentally, an electronic control circuit having the same structure as that shown in FIG. 2 can be used as the electronic control circuit 33.

Figure 4:
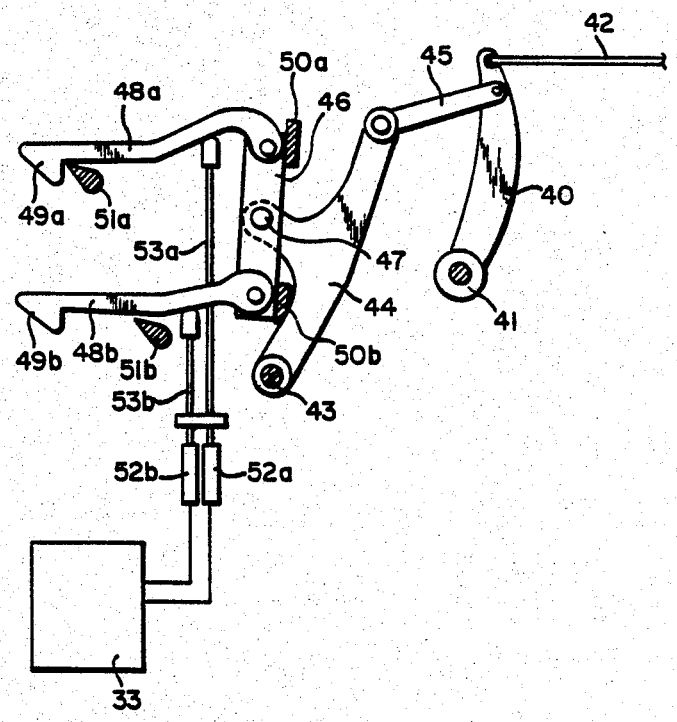
FIG. 4 is a view diagrammatically illustrating the structure of still another embodiment of the apparatus of the present invention.

FIG. 4 illustrates still another embodiment which is applied to a hattersley dobby, where heald frames (not shown) are vertically moved through a wire cable 42 with rotation of a jack lever 40 around a stationary shaft 41. The top end of a lever 44 capable of oscillating with a stationary shaft 43 being as the center is connected to the jack lever 40 through a rod 45, and the intermediate portion of the lever 44 is pivoted on the intermendiate portion 47 of a connecting lever 46. Hook arms 48*a* and 48*b* are pivoted on both the ends of the connecting levers 46, and hooks 49*a* and 49*b* are mounted on the top ends of the hook arms 48*a* and 48*b*. Stoppers 50*a* and 50*b* for the hook arms 48*a* and 48*b* are secured on the side of the machine base. Reference numerals 51*a* and 51*b* represent a pair of reciprocating knives which make reciprocative movements alternately at a certain height so that they are engaged with and disengaged from the hooks 49*a* and 49*b*, and their reciprocative movements are made relative to the rotation of the loom.

Control of the vertical position of the hook arms 48*a* and 48*b* is accomplished by solenoids 52*a* and 52*b* or air cylinders arranged in the vertical direction. More specifically, the top ends of solenoid rods 53*a* and 53*b* which are raised and lowered by turn-on and turn-off of the solenoids 52*a* and 52*b* have abutting contact with the lower faces of the hook arms 48*a* and 48*b*, and on-off control of the solenoids 52*a* and 52*b* is accomplished by a control circuit 33 similar to the electronic control circuit 33 shown in FIG. 2 according to a desired weave texture.

We claim:

1. A dobby of a weaving loom apparatus comprising:

a heald frame;

a heald frame driving lever adapted to actuate said heald frame;

a retaining hook having operative and non-operative positions, so that when said retaining hook is in said operative position, said retaining hook is engaged with a hook formed on said heald frame driving lever, and when said retaining hook is in said non-operative position, said retaining hook is disengaged from said hook on said heald frame driving lever;

solenoid means for determining said operative and non-operative positions of said retaining hook;

an electronic control device having a switch circuit controlling the energization of said solenoid; and a weave texture memory element readable by said electronic control device to appropriately operate said switch circuit.

2. A dobby as claimed in claim 1, wherein said dobby further includes a driving mechanism for said heald frame comprising:

a pair of said retaining hooks, each pivoted on a lever and urged to its lever by a spring;

said levers each being caused to rotate about its individual pivot by at least one said solenoid means appropriately actuated by said electronic control device;

a first lever, pivotally supported at one end thereof on a stationary shaft;

a balanced lever pivotally attached at its intermediate portion to the other end of said first lever;

said balanced lever providing a hook at each end thereof to be engaged with or disengaged from said retaining hooks;

said balanced lever being pivoted by bars attached thereto, said bars reciprocatively and cooperatively acting with motion of a loom;

a jack lever pivotally attached, at one end thereof, to the intermediate portion of said first lever; and a wire cable connecting the other end of said jack lever with said heald frame;

so that as said first lever is pivoted in response to the motion of said balanced lever, said jack lever and said wire cable are caused to move, thereby causing said heald frame to be raised or lowered accordingly.

3. A dobby as claimed in claim 2, wherein the positioning of said retaining hooks to their respective operative and non-operative positions by said solenoid means is performed by a mechanism comprising:

a pair of push levers pivoted upon a common stationary shaft, each of said push levers having a cam roller formed thereon, said cam roller being caused to abut against a surface of said retaining hook with which it cooperates so that as said push lever is caused to pivot, said retaining hook is pivoted to the position for engagement with said hook of said balanced lever;

a pair of locking levers, each pivotally attached, at one end thereof, to one of said push levers;

a cam, disposed intermediate to the length of, and between, said locking levers, said cam being provided with an even number of peaks and troughs formed on the periphery thereof; said cam rotating synchronously with the rotation of a crankshaft of said dobby;

said locking levers each supporting a second cam roller thereon, intermediate to the extent of said locking levers, said second cam rollers each being pressed toward the periphery of said cam by a spring disposed between said locking levers;

a pair of catching levers, each provided with a hook, each catching lever pivotally arranged in the vicinity of the free end of one of said locking levers with which said catching lever cooperates, said catching levers being urged by means of a spring to the position wherein said hooks on said catching levers are not engaged with said free ends of said locking levers; and a pair of solenoids, each having an extended solenoid rod axially movable therethrough, said solenoids being so arranged that the ends of said solenoid rods abut against said catching levers, respectively;

wherein energization of said solenoid causes said solenoid rod to move so that said catching lever is pivoted to a position wherein it engages said locking lever which enables said locking lever, as a peak of said cam engages its second cam roller, to pivot said push lever, causing said retaining hook to be pivoted to a position for engagement with the hook of said balanced lever.

4. A dobby as claimed in claim 1, wherein said solenoid means comprises a pair of solenoids, having solenoid rods axially movable therethrough, each solenoid rod abutting directly upon a surface of the one of said retaining hooks with which it cooperates, so that when said solenoid is energized, said retaining hook is placed in a position to engage the appropriate hook of said balanced lever.

5. A dobby for controlling heald frames comprising:

a jack lever, rotatable about a stationary shaft;

a wire cable for moving said heald frame, said wire cable being attached to the free end of said jack lever, rotation of said jack lever causing said wire cable to move said heald frame;

a lever, capable of oscillating about a stationary shaft, said lever connected to said jack lever through a rod;

a connecting lever, pivotally attached, at its intermediate portion, to the intermediate portion of said oscillating lever;

a pair of hook arms, pivotally attached to the ends of said connecting lever, respectively, each of said hook arms having a hook formed on the free end thereof;

a pair of solenoids controlling the positions of the hook arms, respectively;

a pair of reciprocating knives, able to be engaged with and disengaged from said hooks of said hook arms according to reciprocative movements relative to the rotation of a loom; and an electrical control device having a switch circuit acting on a memory element in which a weave textured data is stored, said electronic control device being connected to said solenoids to appropriately energize and de-energize said solenoids pursuant the weave pattern to be produced.

* * * * *